United States Patent [19]

Kerby

[11] 4,443,301

[45] Apr. 17, 1984

[54] CONTROLLING METAL ELECTRO-DEPOSITION USING ELECTROLYTE CONTAINING TWO POLARIZING AGENTS

[75] Inventor: Robert C. Kerby, Rossland, Canada

[73] Assignee: Cominco Ltd., Canada

[21] Appl. No.: 422,438

[22] Filed: Sep. 23, 1982

[30] Foreign Application Priority Data

Jan. 7, 1982 [CA] Canada ..... 393685

[51] Int. Cl.[3] ..... C25D 21/12; C25D 21/14

[52] U.S. Cl. ..... 204/1 T; 324/71.1; 324/425

[58] Field of Search ..... 204/1 T; 427/8; 324/425, 71.1

[56] References Cited

U.S. PATENT DOCUMENTS

| | | | |
|---|---|---|---|
| 3,925,168 | 12/1975 | Costas | 204/1 T |
| 4,132,605 | 1/1979 | Tench et al. | 204/1 T |
| 4,146,437 | 3/1979 | O'Keefe | 204/1 T |
| 4,217,189 | 8/1980 | Kerby | 204/119 |
| 4,324,621 | 4/1982 | Kerby | 204/1 T |

*Primary Examiner*—G. L. Kaplan

*Attorney, Agent, or Firm*—Wenderoth, Lind & Ponack

[57] ABSTRACT

A method for controlling the electro-deposition of metal from an aqueous electrolyte containing two organic polarizing agents is disclosed. The method requires measuring the nucleation overpotential, the plating overpotential, and the difference between these potentials. By relating these measurements to predetermined values, optimum process control can be obtained by changing the concentration of the various organic polarizing agents in the process electrolyte.

17 Claims, 4 Drawing Figures

Figures 1A, 1B, 1C:
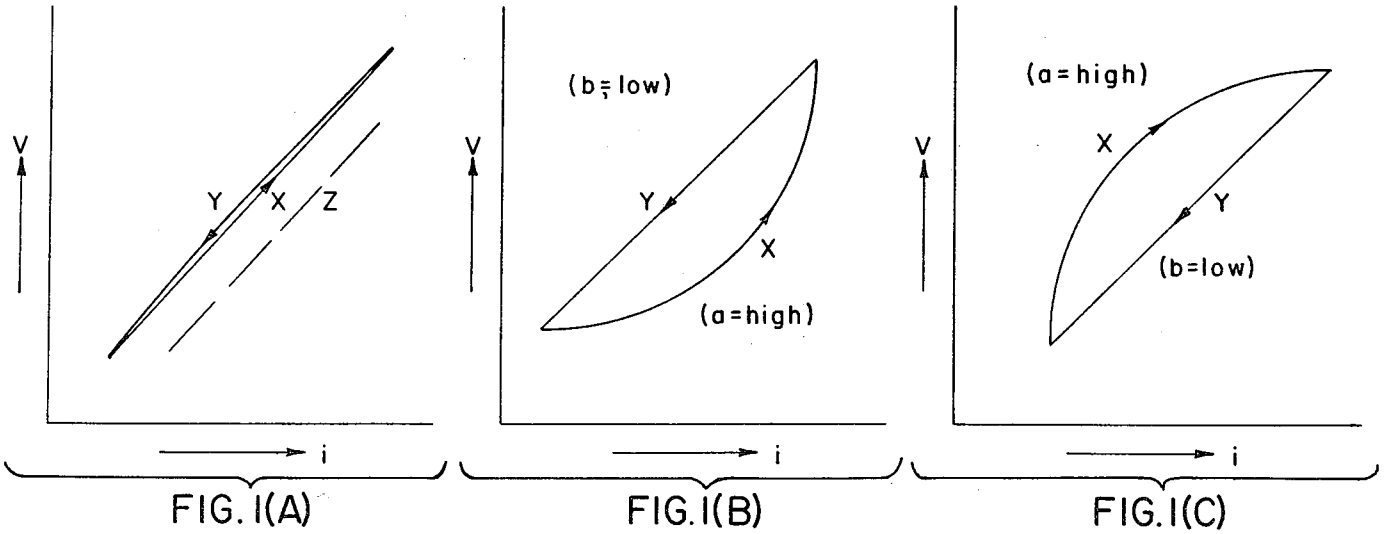

CONTROLLING METAL ELECTRO-DEPOSITION USING ELECTROLYTE CONTAINING TWO POLARIZING AGENTS

This invention relates to a method for controlling the electro-deposition of metals using electrolyte containing two organic polarizing agents. More particularly, this invention relates to a method for measuring values of the cathode polarization overpotentials of metal deposition and controlling the electro-deposition in response to deviations of recorded values of the overpotentials from desired values.

In most electro-deposition processes for metals, one or more addition agents are used in the electrolyte to assist in providing smooth and level deposits, as well as to reduce the effects of impurities. The addition agents are added in amounts to provide optimum deposition and recovery of metal. The control of the concentrations of the addition agents is an important process parameter.

The prior art contains a number of references related to methods for determining the effects of impurities and addition agents on electro-deposition processes for metals by establishing current overpotential relationships.

According to U.S. Pat. No. 3,925,168, L. P. Costas, Dec. 9, 1975, the amount of active roughening agent in a plating bath is determined by measuring the overpotential-current density relationships of solutions having varying known addition agent content and comparing the results with those of a solution with known characteristics. According to Canadian Pat. No. 988,879, C. J. Krauss et al, May 11, 1976, the cathode polarization voltage is determined in relation to current density in a lead refinery electrolyte, wherein the slope of the polarization voltage-current density curve is a measure of the amount of addition agents. C. L. Mantell et al (Trans. Met. Soc, of AIME, 236, 718–725, May 1966) showed that current-potential curves related to hydrogen evolution were sensitive to impurities in manganese electrowinning solutions. H. S. Jennings et al (Metallurgical Transactions, 4, 921–926, April 1973) describe a method for measuring cathodic polarization curves of copper sulfate solutions containing varying amounts of addition agents by varying an applied voltage and recording the relationship between voltage and current density. O. Vennesland et al (Acta Chem. Scand., 27, 3, 846–850, 1973) studied the effects of antimony, cobalt, and beta-naphthol concentrations in zinc sulfate electrolyte on the current-potential curve by changing the cathode potential at a programmed rate, recording the curves and comparing the curves with a standard. T. N. Anderson et al (Metallurgical Transactions B, 7B, 333–338, September 1976) discuss a method for measuring the concentration of glue in copper refinery electrolyte by determining polarization scan curves, which upon comparison provide a measure of glue concentration. According to U.S. Pat. No. 4,146,437 issued Mar. 27, 1979, T. J. O'Keefe, cyclic voltammograms, which include the cathodic deposition and the anodic dissolution portions of h current-potential relationships, as well as polarization curves, are recorded as a means for approximating the quantities of impurities and addition polarization affecting agents in zinc and copper sulfate electrolytes.

According to my co-pending Canadian Patent Application No. 306,805 which was filed on July 5, 1978, a potential between a cathode and a reference electrode in zinc sulphate electrolyte is decreased at a constant rate at substantially zero current. When the value of the current starts to increase above zero, the activation overpotential is determined and related to the concentration of impurities, and the process is adjusted to obtain optimum recovery of zinc.

In my co-pending Canadian Patent Applications Nos. 332,698 filed July 27, 1979 and 353,993 filed June 13, 1980, there is disclosed a method for controlling a process for the electro-deposition of metals which comprises applying a controlled low current to measure the activation overpotential at the point of inchoate deposition of the metal and relating the activation overpotential to the concentrations of impurities and polarization affecting agents to obtain optimum metal deposition.

Although these prior art methods make it possible to control metal deposition by controlling the concentrations of impurities and polarization affecting agents, these methods do not provide steps necessary to effectively control processes in which two organic polarizing agents are used.

In electrolytic processes wherein two organic polarizing agents are used, deviations occur sometimes which affect the quality of the electro-deposited metal, in spite of controlling the electrolytic process by measuring overpotentials as disclosed in prior art methods. Such deviations are related to the concentrations of the polarizing agents in the electrolyte. Where two organic polarizing agents are used, one often has a major effect on the grain refining of the metal deposition, thereby affecting the density of the deposited metal, while the other agent has a major effect on the levelling of the deposit, thereby affecting its smoothness and levelness. When measuring overpotentials for metal deposition in an electrolytic system comprising electrolyte containing dissolved metal and two organic polarizing agents, two cathode overpotenials can be measured. One overpotential is associated with the initial deposition of metal or the nucleation of metal deposition onto a cathode substrate. This overpotential will be referred to hereinafter as the nucleation overpotential. The second overpotential is associated with metal deposition onto previously electro-deposited metal and will be referred to hereinafter as the plating overpotential.

It has now been discovered that when the nucleation overpotential and the plating overpotential are measured in an electrolytic system that contains two organic polarizing agents, one largely affecting the grain refining, the other largely affecting the smoothness and levelness of the metal deposit, a difference often exists between the values of the two potentials. This difference can be directly correlated with the concentrations of the agents. It has also been discovered that the values of the plating overpotential are directly related to the concentration of the levelling affecting agent and that values of the nucleation overpotential are related to the concentration of the grain refining affecting agent. Furthermore, the concentration of the grain refining agent is, more specifically, related to the difference between values of the nucleation overpotential and values of the plating overpotential. By maintaining the difference between potentials at a predetermined value or within a predetermined range of values, and by maintaining the value of the plating overpotential at a predetermined value or within a predetermined range of desired values, the concentrations of the polarizing agents can be maintained at predetermined desired values or within a predetermined range of desired values, to consistently give dense and level metal deposits. Thus, by determining values of the nucleation and plating overpotentials in relation to the concentrations of the two organic polarizing agents, any deviation from optimum conditions to give dense and level metal deposits can be corrected by changing the concentration of one or the other polarizing agent; by changing the concentration of both agents in the electrolyte; or by adding a de-polarizing agent Further, if the concentration of both polarizing agents is changed, it does not follow that both will have to be changed in the same sense: thus one concentration can be raised and the other lowered if need be rather than both raised or both lowered.

The method of the invention is particularly useful in processes for the electro-deposition of metals such as lead, copper, zinc, iron, cobalt, nickel, manganese, chromium, tin, cadmium, bismuth, indium, silver, gold, rhodium and platinum, and wherein two organic polarizing agents are used.

Accordingly, there is provided a method for controlling the electro-deposition of metals using an electrically conductive aqueous electrolyte containing concentrations of two organic polarizing agents, including one agent which affects primarily grain refining, and one agent which affects the smoothness and levelness of the metal deposit, which method comprises:

(a) establishing a test cell circuit including at least one test cell; a sample of electrolyte; at least one anode; at least one cathode having a constant area in contact with the electrolyte, at least one reference electrode; a current supply means which is electrically connected to the anode(s) and the cathode(s), and an overpotential measuring means connected between the cathode and the reference electrode;

(b) applying a current in the test cell sufficient to cause electro-deposition of metal;

(c) measuring, between a cathode and a reference electrode in a test cell the overpotential associated with either the initial deposition or the nucleation of metal deposition onto a clean cathode surface, and termed the nucleation overpotential;

(d) measuring, between a cathode and a reference electrode in the test cell the overpotential associated with metal deposition onto previously deposited metal, and termed the plating overpotential;

(e) relating the measured values of the nucleation overpotential, of the plating overpotential, and of the difference between values of the nucleation and plating overpotentials to previously determined optimum values; and (f) adjusting the process by changing the concentration of at least one of the organic polarizing agents in the electrolyte to obtain optimum metal deposition conditions when deviations from optimum values occur.

The invention will now be described in detail. The apparatus to carry out the method of the invention generally consists of a test circuit which comprises at least one test cell, a sample of electrolyte, at least one each of an anode, a cathode and a reference electrode, means to supply a current between each cathode and anode, and means for measuring the nucleation overpotential and the plating overpotential between the cathode(s) and the reference electrode(s). (The number of cells and electrodes to be used will become clear from the following description).

The test cell is a small container of suitable cross-section made of a material, not corrodable by electrolyte It is large enough to contain the electrodes and to hold a suitable sample of electrolyte. Means are provided in the cell to make it possible to continuously or intermittently add electrolyte to, and discharging electrolyte from, the cell. When using more than one cell, samples obtained from the same source are used. The electrodes are immersed in the electrolyte sample and are removably positioned in the cell at constant distances from each other.

The anode may be made of the same material as the metal being deposited but is preferably made of a suitably inert material that allows gas evolution. Depending on the electrolyte composition, suitably inert anode materials are selected from lead-silver alloys, platinum and graphite. The reference electrode can be any one of a number of suitable reference electrodes such as, for example, a standard calomel electrode. If desired, a reference electrode may consist of a metal rod immersed in electrolyte in a Luggin probe in close proximity to a cathode surface via a capillary. One or more anodes and reference electrodes can be used, as will be explained hereinafter.

The cathode is made of a suitable, electrically conductive material appropriate for use in the electro-deposition process of the metal being deposited and which material is compatible with the electrolyte used in the process. The material of the cathode may be made of the same metal as the metal being deposited or may be made of a metal which is different from the metal being deposited.

For the cathode either a single stationary cathode, or one or two moving cathodes can be used. When using a single stationary cathode, the method of the invention is conducted in a batch or intermittent fashion. The single cathode is associated with one anode and one reference electrode. When using a moving cathode, or cathodes, the method of the invention can be conducted in a continuous manner. In the continuous method, each moving cathode is used in association with a reference electrode and in association with one common anode or each in association with a separate anode. When using two cathodes and a common anode, the electrodes are preferably placed in one cell. When using two cathodes and two anodes, each set of electrodes consisting of a cathode, an anode and a reference electrode is placed in a separate cell. In the former case, therefore, one cell is used. When the cathode is made of a material which is different from the metal being deposited, the cathode material may be chosen from aluminum or suitable aluminum alloys, titanium, iron, steel, stainless steel, nickel, lead, copper and the like.

The material should be compatible with the electrolytic system of the metal being deposited and have a smooth, clean surface, possess corrosion resistant properties in the electrolyte and have electrochemical characteristics that produce reproducible test results.

The cathode has a constant area of its surface in contact with the electrolyte in the cell. A contact surface in the range of about 0.1 to 10 $cm^2$ gives excellent results. The cathode may be in the form of a wire, a strip, or a coupon or a small plate. Movable cathodes are preferably in the form of a strip or wire.

The cathode is contained in a cathode holder. The holder envelopes the cathode except for the constant surface area which is in contact with electrolyte. In the case of a stationary cathode, the cathode is preferably clamped in fixed position in the cathode holder, while in the case of one or two moving cathodes the cathodes can be moved through the respective cathode holder.

Means are provided to move moving cathodes continuously through the cathode holder and consequently in contact with electrolyte. Each moving cathode is contained in a separate cathode holder. When using a common anode, the cathode holders are preferably spaced in the cell as far apart from each other as possible. The moving means include provisions to move the cathodes at different rates.

The electrodes are electrically connected to a source of current and to potential measuring means for measuring the nucleation overpotential and the plating overpotential. The current source, which may supply either a constant current or a variable current, is connected to the anode and the cathode. In the case wherein two anodes and two cathodes are used, the current is supplied to the anodes and cathodes connected in series. The measuring means measures the overpotentials on the cathode(s) relative to the reference electrode(s). The measured nucleation overpotential and the plating overpotential may be recorded for example, on a suitable read-out instrument, or, alternatively, may be recorded in the form of a line or trace as a function of the current. The measuring means preferably include means to record the difference between the measured values of the nucleation overpotential and the measured values of the plating overpotential. The values of the overpotentials and the difference may be recorded as a function of time. Most preferably, the values of the difference and the values of the plating overpotential are recorded as a function of the concentrations of the addition agents.

The electrodes are removably positioned in the cell in fixed relation to each other. Good results are obtained when the cathode is positioned about 4 cm away from the anode and the reference electrode is not more than about 1 cm away from the cathode. In the case of using a Luggin probe in combination with a cathode, the tip of the capillary should be in close proximity with the cathode surface.

Means may be provided to maintain the electrolyte in the cell at a suitable constant temperature.

Figure 2:
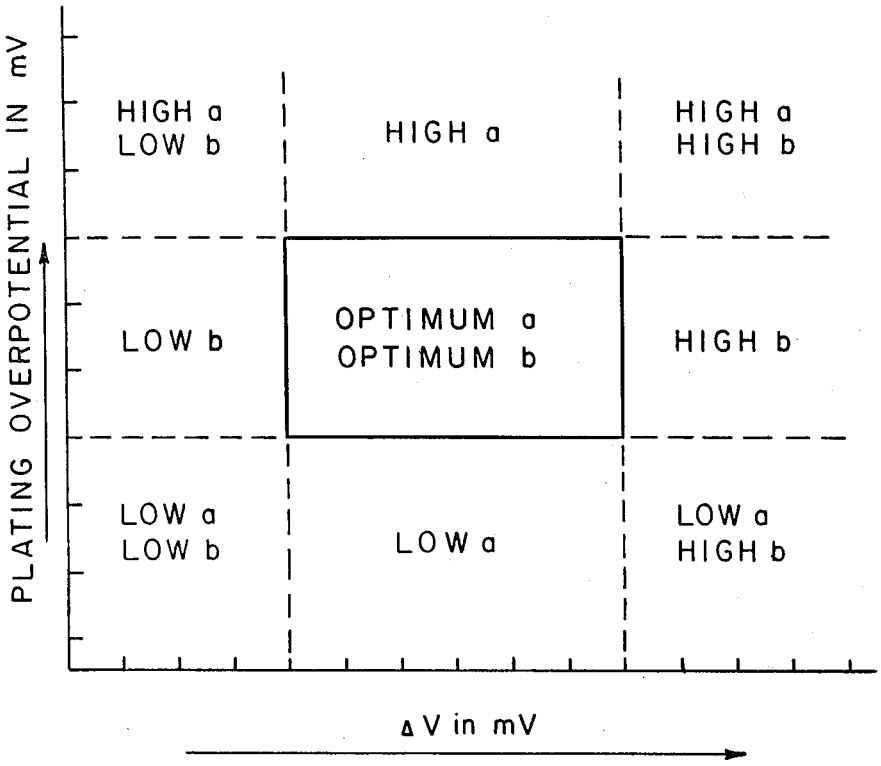

In the following description of the method of the invention, reference will be made to the attached drawings wherein FIG. 1, shows current-voltage relationships indicative of various concentration ratios of polarizing agents, and FIG. 2 illustrates the concentration relationships between the two polarizing agents as a function of values of the plating overpotential and values of the difference between values of the nucleation overpotential and the plating overpotential.

A sample of electrolyte containing two organic polarizing agents is added to the test cell. To ensure reproducible results, the sample is kept in motion by agitation or circulation. Preferably, the sample is kept in motion by continuously passing a small flow of electrolyte through the test cell. In the case of using two test cells, the flow of electrolyte is passed through both cells. If desired, electrolyte added to the cell may be adjusted to certain concentrations of, for example, metal and acid content to reduce the effect of concentration variations in the tests to a minimum and to obtain reproducible results.

The measuring of the nucleation overpotential and the plating overpotential of an electrolyte can be carried out by one of two methods. Generally, the nucleation overpotential of a sample of electrolyte containing two organic polarizing agents is determined by applying a current between a cathode having a fresh surface and an anode and measuring values of the nucleation overpotential between the cathode and a reference electrode when metal nucleates or is initially deposited onto the cathode. Values of the nucleation overpotential can be measured as long as metal continues to be deposited onto a portion of the cathode material which is not covered with deposited metal. The plating overpotential of the sample is determined by applying a current between an anode and a cathode covered with previously deposited metal such that metal deposits onto deposited metal. Values of the plating overpotential are measured between the cathode and a reference electrode. The measured values of the two overpotentials are recorded against current or current density. Differences between the measured values of the two overpotentials may also be recorded, the magnitude of the differences being directly related to the concentrations of the agents. Alternatively, the values of the plating overpotential can be recorded as a function of the differences between the values of the two overpotentials. The record provides a direct relationship between the overpotentials and the relative concentrations of the two organic polarizing agents.

According to the first method for carrying out the process of the invention, the cathode is stationary. A current is applied between the anode and the stationary cathode and the overpotentials are measured between the cathode and the reference electrode. The current is increased and decreased at a suitable rate. Preferably, the current is increased from a value of zero to a maximum value at which the cathode is substantially covered with metal electro-deposited from the electrolyte. Most preferably, the current, expressed as current density, is increased at a substantially constant rate, which may be in the range of from 5 to as high as 1000 $A/m^2$/-min. The preferred rate is in the range of about 100 to 200 $A/m^2$/min. Values of the nucleation overpotential are measured and recorded during the period of increasing current. At the end of the period of increasing current, the current is decreased, preferably at the same substantially constant rate. Preferably the current is decreased until it has reached a value of zero. During the period of decreasing current, values of the plating overpotential are measured and recorded. If necessary, if at the end of the period of increasing current the cathode is not yet substantially covered with deposited metal, the current may be held at a constant value before decreasing the current to ensure that values of the plating overpotential are measured.

The range of values over which the current, expressed as current density, is increased should be such that metal nucleates and deposits onto fresh cathode surface and that, when the current is decreased, metal deposits on to previously desposited metal. The range should preferably include the value or values of the current density at which the electro-deposition process is usually operated. A range of currents, expressed as current densities of from 0 to about 600 $A/m^2$ is adequate for most electro-deposition processes.

When the values of the nucleation overpotential and the values of the plating overpotential are recorded against values of the current or current density as a curve or trace, a number of configurations of the curves is possible as shown in FIGS. 1A, 1B and 1C, depending on the relative concentrations of the two polarizing agents. The organic polarizing agents are referred to hereinafter as a and b. Agent a is the one mainly affecting the levelling of the deposit and agent b is the one mainly affecting the grain refining. When the polarizing agents are both present in the electrolyte in the desired concentrations and the material of the cathode is the same as the metal being deposited, the curve X, which represents the values of the nucleation overpotential, substantially coincides with the curve Y, which represents the values of the plating overpotential, as shown in FIG. 1A. When the concentration of agent a or of agent b is less or more than the desired concentration, the concentration ratio consequently becomes greater or smaller than the desired values and curve X representing the values of the nucleation overpotential will be situated away from the curve Y representing the values of the plating overpotential, as shown in FIGS. 1B and 1C. FIG. 1B, for example, represents instances wherein the concentration of agent a is greater or that of agent b is less than the desired concentration, i.e., the electrolyte contains an excess of the agent a or a deficiency of agent b, and the curve indicated at X represents values of the measured nucleation overpotential, while the curve indicated at Y represents values of the measured plating overpotential. FIG. 1C represents similar curves X and Y but this case represents instances wherein the concentration of the agent b in the electrolyte is greater or that of the agent a is less than the desired concentration.

In both FIGS. 1B and 1C a distinct difference exists between the values of the nucleation overpotential and the values of the plating overpotential, and in both cases the concentrations of at least one of the two agents differs from the desired values.

The presence of a greater or lesser excess or deficiency of the respective organic polarizing agents will cause variations in the position of the nucleation overpotential curve X relative to the position of the polarizing overpotential curve Y. Therefore, the value of the overpotential differences between the two curves varies with the relative concentrations of the two organic polarizing agents. As can be seen from these curves, this difference can also be either positive or negative, taking the polarization overpotential as the reference point.

When the material of the cathode is different from the metal being deposited, the position of the nucleation overpotential curve relative to the plating overpotential curve depends on the overpotential of the cathode material. In this case the position of the nucleation overpotential curve may be shifted away from the plating overpotential curve resulting in the existence of a basic potential difference independent from the concentration of the two polarizing agents as shown, for example, by curve Z in FIG. 1A. In this situation it can be seen that the two curves do not necessarily coincide when the desired or optimum concentration ratio between the organic polarizing agents is present.

In order to determine whether the correct relative concentrations of the polarizing agents are present, the values of the difference $\Delta V$ in mV between the values of the nucleation overpotential and the plating overpotential may be recorded against the values of the concentrations of the agents. Preferably, the $\Delta V$ at a particular value of the current or current density is recorded, as is illustrated in FIG. 2.

In FIG. 2, the relationship between values of the overpotentials and the relative concentrations of the polarizing agents is graphically illustrated. Values of the differences $\Delta V$ in mV between the measured values of the nucleation overpotential and those of the plating overpotential at one value of the current applied between the anode and the cathode in the test cell are plotted against the measured values of the plating overpotential. Values of $\Delta V$ are expressed hereinafter as values of the nucleation overpotential minus values of the plating overpotential. The value of the current, expressed as current density, is usually chosen to be the value of the current density at which the electro-deposition process of the metal is carried out.

In addition to measuring the two potentials and determining the relationship between the concentration of the polarizing agents and the difference between the potentials, it is necessary to control the value of the plating overpotential at the chosen current density within a range of values. Every solution composition of electrolyte has an optimum value or range of values for the plating overpotential at which or wherein good deposits are obtained.

Similarly, every solution composition has an optimum value or range of values for the difference between the potentials at which or wherein good deposits are obtained. These optimum values or ranges of values correspond with optimum concentrations of agent a and agent b and is shown in FIG. 2 as the demarcated area. When the values of $\Delta V$ and the plating overpotential are not optimum and the deposited metal is of lesser quality, several situations may exist. Each situation represents other than optimum conditions caused by deviations in the concentration of either one agent or both agents. The areas wherein the various situations occur are generally indicated in FIG. 2. It is understood that all the areas can not be clearly demarcated because a degree of overlap usually exists between all areas, including the demarcated area, and because the relative position of all areas depends on the electrolytic process being controlled. The area of optimum values has been demarcated mainly for reasons of convenience.

By determining the values of the nucleation and plating overpotentials in electrolytes containing varying concentrations of the two organic polarizing agents, and by determining the quality of the metal electrodeposits, the optimum area for obtaining good deposits can be established as well as the areas of deviations from the optimum related to the relative concentrations of the polarizing agents. Using these determinations, the electrolytic process can be controlled by measuring the nucleation and plating overpotentials, the values of which are then directly related to the concentrations of the two polarizing agents. Deviations from optimum concentration can be readily corrected, such as for example, by increasing or decreasing the rate of addition of one or the other agent, or of both agents.

If the plating overpotential is outside the desired range, adjustment to the process can be made also by adding a de-polarizing agent. For example, in the electrorefining of lead, certain thiosulfates act as de-polarizing agents and the addition of a suitable thiosulfate reduces the plating overpotential. In the electrowinning of zinc, the addition of antimony has a similar effect.

In the second method for carrying out the process of the invention, the measuring of the nucleation overpotential and the plating overpotential is carried out continuously and can be carried out in one test cell containing one or two moving cathode(s), movably contained in a cathode holder(s). As described above, the test cell also contains one anode which may be common between two cathodes, or two anodes, as well as one or two reference electrode(s), associated with the moving cathode(s). Alternatively, the second method can be carried out in two test cells, each cell containing a moving cathode, an anode and a reference electrode. A constant current is applied between each of the moving cathode(s) and the anode(s). The material of the cathode can be the same as or different from the metal being deposited. When using two cathodes, one cathode can be of the same and the other of a different material. The cathode(s) can be moved at different rates through the cathode holder and the value of the applied current can be the same. Using one cathode, the cathode can be moved at an alternately high and low rate, such that at high rate the nucleation overpotential and at low rate the plating overpotential is measured. Alternatively, when using two cathodes, the cathodes can be moved at the same rate and the value of the current applied to one cathode must then be different from the current applied to the other cathode. In both alternatives, the rate(s) of the moving cathodes or the value(s) of the applied currents must be such that the nucleation overpotential is measured on the one cathode and the value of the plating overpotential is measured on the other cathode.

In the preferred embodiment of the second method, a current is applied to the cathode(s) at the same substantially constant value and the cathode(s) is (are) moved at different rates. The substantially constant value of the current can be selected from a range of values but is preferably equivalent to the current expressed as current density used in the electro-deposition process. The moving cathode(s) is (are) advanced through the cathode holder(s) continuously and at different rates, each one of which is preferably a constant rate.

For a moving cathode the rate of movement is dependent on the ratio between cathode length and cathode surface area, the value of the current density, the surface area of the cathode exposed to electrolyte, the fraction of exposed cathode area covered with deposited metal and the weight of deposited metal. The rate is also somewhat dependent on the degree of motion of electrolyte in the cell. Thus, the rate at which a cathode is moved through the cathode holder and, consequently, through the electrolyte, may vary in a range of values. At high rates, metal deposition is not allowed to progress sufficiently to cover all of the cathode surface; metal is deposited onto fresh cathode surface causing only partial covering of the surface and the nucleation overpotential is measured. At rates below a certain transition value, metal deposition will take place onto previously deposited metal and the plating overpotential is measured. The transition rate is defined as that rate below which the plating overpotential is measured, i.e., the cathode is covered completely with deposited metal, and above which the nucleation overpotential is measured, i.e., the cathode is incompletely covered with deposited metal. The transition rate substantially corresponds with the rate which the exposed cathode surface becomes first substantially covered with deposited metal. The transition rate may be calculated by using the following formula:

$$R\ \text{trans} = \frac{abcd}{Xy}\ \text{cm/h}$$

wherein:

a represents the cathode length to surface area ratio in cm/cm$^2$;

b represents the current density in A/cm$^2$;

c represents the cathode exposed area in cm$^2$;

d represents the electrochemical equivalent for the metal being deposited in g/Ah;

x represents the fraction of the exposed cathode area covered with metal (X=1 for the transition rate); and y represents the weight of deposited metal per unit of cathode surface area in g/cm$^2$.

The transition rate of movement of a moving cathode as defined above can be determined by depositing metal onto segments of a moving cathode of known dimensions at various rates of movement. The values for the variables a. c and d in the equation are known and the values of the variables X and y can be approximately determined with the use of a scanning electron microscope. For the transition rate the value of X should equal one. Carrying out these determinations at various current densities quickly shows the value of the current density at which good responses are obtained with respect to recorded values of the two potentials. In some cases, this value of the current density, i.e. the value of variable b, is approximately the same as that at which the electro-deposition process is operated.

For measuring the nucleation overpotential, the rate of cathode movement is preferably from about two to ten times the transition rate. To avoid deposition of too much metal when measuring the nucleation overpotential, not more than about 90%, preferably about 50% of the cathode surface in contact with electrolyte should become covered with deposited metal.

When measuring the plating overpotential, the rate should be less than the transition rate to ensure that deposition of metal occurs onto previously deposited metal and the plating overpotential is thus measured. The rate is preferably one half to one tenth times the transition rate.

The two potentials are measured continuously and values are recorded as a function of time. Alternatively, values of the plating overpotential and the values of the differences between the values of the two potentials are recorded against time. The recordings are then related to the concentrations of the two polarizing agents and any corrections to the process are made as required.

The invention will now be illustrated by means of the following nonlimitative examples:

EXAMPLE 1

Tests were conducted to determine the relationships between concentrations of two polarizing agents and values of the nucleation and plating overpotentials in the process for the electrorefining of lead.

The apparatus consisted of a controlled power source with a linear rate of change in current output, a test cell (5×13×10 cm) with removable electrode holders providing 6.45 cm$^2$ of electrode area exposed to electrolyte. Refined lead starting sheet coupons were used for the cathode and anode bullion coupons were used for the anode. The reference electrode consisted of a rod of refined lead immersed in electrolyte and connected to the cathode surface via a Luggin capillary. Constant temperature of 40° C. and stirring were provided in the cell. The electrolyte contained 75 g/L Pb as lead-fluosilicate, 90 g/L fluosilicic acid and varying amounts of Aloes, a levelling affecting agent and lignin sulfonate, a grain refining affecting agent.

The current expressed as current density applied between anode and cathode was increased at a linear rate of 150 A/m$^2$/min from 0 to 300 A/m$^2$, the current was then decreased at the same rate to zero current. For each composition of electrolyte, the increasing and decreasing potential curves were recorded. The values of the plating overpotential, and the nucleation overpotential at a current density of 200 A/m$^2$ were determined and the difference between the values of the potentials was calculated.

To determine the quality of lead deposits, electrorefining tests were concurrently conducted using the corresponding electrolyte compositions at 40° C. and a current density of 200 A/m$^2$. The electrolyte was continuously recirculated through the refining cell. Electrolyte, Aloes and liqnin sulfonate additions were made during the seven day deposition to maintain constant volume and electrolyte composition. After the deposition the quality of the refined lead was visually determined.

The additions of polarizing agents, the overpotentials and potentials differences, and the deposit quality are tabulated in Table I.

TABLE 1

| Additions to Electrolyte | | Overpotentials | | | |
|---|---|---|---|---|---|
| Aloes mg/L | Lignin Sulfonate mg/L | Nucleation mV | Plating mV | ΔV* mV | Deposit Quality |
| 0.5 | 2 | 45 | 50 | −5 | rough |
| 0.5 | 4 | 61 | 50 | 11 | rough |
| 0.5 | 6 | 55 | 48 | 7 | rough |
| 1 | 0 | 41 | 57 | −16 | rough |
| 1 | 2 | 55 | 68 | −13 | rough |
| 1 | 4 | 60 | 65 | −5 | rough |
| 1 | 6 | 60 | 63 | −3 | rough |
| 1 | 8 | 60 | 62 | −2 | rough |
| 1.5 | 2 | 78 | 85 | −7 | smooth |
| 1.5 | 4 | 82 | 80 | 2 | smooth |
| 1.5 | 6 | 80 | 77 | 3 | rough |
| 1.5 | 8 | 77 | 72 | 5 | rough |
| 2 | 2 | 90 | 99 | −9 | smooth |
| 2 | 4 | 85 | 92 | −7 | smooth |
| 2.5 | 2 | 99 | 105 | −6 | rough |
| 2.5 | 4 | 95 | 101 | −6 | rough |

*ΔV = Nucleation overpotential minus plating overpotential.

The tabulated results show that, under the conditions of the tests of this example, smooth, i.e. dense and level, deposits are obtained when the plating overpotential is maintained at values in the range of 80 to 100 mV, and the difference between nucleation and plating overpotentials is maintained in the range of −10 to +2 mV which corresponds to maintaining the active concentrations of the polarizing agents in the ranges of 1.5 to 2 g/L Aloes and 2 to 4 g/L lignin sulfonate.

When a diagram is composed for these tests on the basis of FIG. 2, the area demarcated by 80 and 100 mV for the plating overpotential and −10 to +2 mV for the difference between potentials is the area of optimum conditions for obtaining dense and level metal deposits. Areas in the diagram below the 80 mV value of the plating overpotential are generally representative of electrolytes having too low, and areas above 100 mV having too high an Aloes concentration. Areas in the diagram wherein the ΔV has a value below −10 mV are generally representative of electrolytes having too low, and areas above +2 mV having too high a concentration of lignin sulfonate.

EXAMPLE 2

Tests were conducted to determine the relationships between concentrations of polarizing agents and values of the nucleation and plating overpotentials in the process for electro-deposition of lead.

Values of the nucleation and plating overpotentials were continuously measured using a test cell having a sample volume of 500 mL. A volume of electrolyte containing 70 g/L lead as leadfluosilicate, 95 g/L fluosilicic acid and varying amounts of Aloes and lignin sulfonate was continuously circulated through the cell. Immersed in the electrolyte in the cell were a moving cathode consisting of a 0.1291 cm diameter copper wire contained in and advanced through a stationary cathode holder fixedly positioned in the cell allowing 0.234 cm$^2$ of the cathode to be exposed to electrolyte, a lead anode and a lead reference electrode in a Luggin probe positioned between cathode and anode. The surface of the exposed area of the moving cathode was 4 cm away from the surface of the anode and the tip of the capillary of the Luggin probe was in close proximity to the cathode. The temperature of the electrolyte flowing through the test cell was controlled at 40° C. The anode and the moving cathode were connected to a source of constant current, and the reference electrode and the cathode were connected to the measuring means for the overpotentials including a voltmeter with digital readout and a recorder. Current was supplied between the anode and the moving cathode to give a cathode current density of 200 A/m$^2$. The transition rate R trans. of cathode movement was determined and calculated to be 226 cm/h.

$$R\ \text{trans} = \frac{2.5 \times 0.02 \times 0.234 \times 3.865}{1.0 \times 0.002}$$

The copper wire cathode was moved through the cathode holder at a rate of 312 cm/h and the nucleation overpotential was continuously recorded against time until steady state conditions were reached (about one minute). The plating overpotential was subsequently measured at the same current density and recorded with the cathode being advanced at a rate of 102 cm/h. Values of the two potentials were determined for varying amounts of the addition agents in the electrolyte.

The quality of electro-deposited lead was determined by electro refining tests as described in Example 1 using corresponding electrolyte compositions. The test results are given in Table II.

TABLE II

| Addition to Electrolyte | | Overpotentials | | | |
|---|---|---|---|---|---|
| Aloes mg/L | Lignin Sulfonate mg/L | Nucleation mV | Plating mV | ΔV mV | Deposit Quality |
| 0.5 | 2 | 41 | 51 | −10 | rough |
| 0.5 | 4 | 46 | 55 | −9 | rough |
| 1 | 2 | 50 | 78 | −28 | rough |
| 1.5 | 2 | 61 | 89 | −28 | smooth |
| 1.5 | 4 | 57 | 82 | −25 | smooth |
| 1.5 | 6 | 54 | 76 | −22 | rough |
| 2 | 2 | 58 | 109 | −51 | smooth |
| 2 | 4 | 77 | 107 | −30 | smooth |
| 2.5 | 2 | 96 | 142 | −46 | rough |

Satisfactory, i.e. smooth, level and dense, deposits are obtained under the conditions of this example when the plating overpotential is maintained at values in the range of 80 to 110 mV and the difference between the nucleation and plating overpotentials is maintained at values in the range of −52 to −20 mV. These optimum ranges correspond to maintaining the active concentrations of the polarizing agents in the ranges of 1.5 to 2 g/L Aloes and 2 to 4 g/L lignin sulfonate. A diagram based on FIG. 2 for these optimum and the less and more than optimum conditions will define areas wherein either one agent is or both agents are present in too low or too high a concentration.

EXAMPLE 3

Tests similar to those of example 1 were conducted in the electrorefining process for copper. Using the apparatus as described in Example 1, but using electrodes of refined copper and a reference electrode of a copper rod in a Luggin probe, electrolyte samples containing 20 g/L Cu as $CuSO_4$, 150 g/L $H_2SO_4$, 30 mg/L chloride ions and varying amounts of glue, a levelling affecting agent, and thiourea, a grain refining affecting agent, were tested. The electrolyte was stirred and kept at 50° C.

The current, expressed as current density, applied between anode and cathode was increased at a linear rate of 150 A/m²/min. from 0 to 300 A/m² and decreased to zero at the same rate. For each electrolyte composition, the values of the plating and nucleation overpotentials were determined from the recorded potential curves at a current density of 100 A/m² and the difference between the values of the overpotentials was calculated.

The quality of copper deposits was determined from one day copper deposits obtained from electrorefining tests at 50° C. and 100 A/m² using corresponding electrolyte compositions.

The amounts of added addition agents, the overpotentials and the differences between the potentials, and the quality of the deposits are given in Table III.

TABLE III

| Additions to Electrolyte | | Overpotentials | | | |
|---|---|---|---|---|---|
| Glue mg/L | Thiourea mg/L | Nucleation mV | Plating mV | ΔV mV | Deposit Quality |
| 0 | 0 | 47 | 18 | 29 | rough |
| 0.5 | 0 | 60 | 20 | 40 | rough |
| 0.5 | 0.5 | 60 | 12 | 48 | rough |
| 5 | 10 | 175 | 35 | 140 | rough |
| 10 | 10 | 162 | 62 | 100 | rough |
| 5 | 0 | 78 | 37 | 41 | rough |
| 10 | 0 | 80 | 67 | 13 | smooth |
| 20 | 0 | 85 | 70 | 15 | smooth |
| 5 | 5 | 180 | 25 | 155 | rough |
| 10 | 5 | 180 | 95 | 85 | smooth |
| 20 | 5 | 130 | 75 | 55 | smooth |
| 20 | 10 | 200 | 175 | 25 | rough |

The results show that smooth, dense deposits are obtained under the conditions of this example, when the plating overpotential is maintained at values in the range of 50 to 100 mV and the difference between nucleation and plating overpotentials is maintained at values in the range of 0 to 95 mV, which corresponds to maintaining the active concentrations of the polarizing agents in the ranges of 10–20 mg/L glue and 0 to 5 mg/L thiourea.

When a diagram is composed for these tests on the basis of FIG. 2, the area bordered by 50 and 100 mV for the plating overpotential and 0 to 85 mV for the difference between overpotentials is the area of optimum conditions for obtaining dense and level copper deposits. Areas in the diagram below the 50 mV value of the plating overpotential are generally representative of electrolytes having too low and areas above 100 mV having too high a glue concentration. Areas wherein ΔV has a value below zero mV are generally representative of electrolytes having too low and areas above 85 mV having too high a concentration of thiourea.

EXAMPLE 4

Tests were conducted to determine the relationships between concentrations of polarizing agents and values of the nucleation and plating overpotentials in the process for the electrorefining of copper.

Values of the nucleation and plating overpotentials were continuously measured using a test cell having a sample volume of 500 mL. A volume of electrolyte was passed through the cell. Immersed in the electrolyte in the cell were a moving cathode consisting of a 0.1291 cm diameter copper wire contained in and advanced through a stationary cathode holder fixedly positioned in the cell allowing 0.234 cm² of the cathode to be exposed to electrolyte, a lead anode and a SCE positioned between cathode and anode. The surface of the exposed area of the moving cathode was 4 cm away from the surface of the anode and the tip was not in direct line between the anode and the exposed area of the cathode. The anode and the moving cathode were connected to a source of constant current, and the reference electrode and the cathode were connected to the measuring means for the overpotentials including a voltmeter with digital read-out and a recorder.

The electrolyte containing 20 g/L Cu as $CuSO_4$, 150 g/L $H_2SO_4$, 30 mg/L chloride ions and varying amounts of glue and thiourea was continuously circulated through the test cell and maintained at 50° C.

Current was supplied between the anode and the moving cathode to give cathode a current density of 200 A/m². The transition rate R trans of cathode movement was determined and calculated to be 139 cm/h.

$$R\ \text{trans} = \frac{2.5 \times 0.02 \times 0.234 \times 1.186}{1.0 \times 0.0001}$$

The copper wire cathode was moved through the cathode holder at a rate of 312 cm/h and the nucleation overpotential was continuously recorded against time and measured until steady state conditions were reached (about one minute).

At the same current density, the plating overpotential was measured and recorded with the copper wire being advanced through the electrolyte at a rate of 102 cm/h.

To determine the quality of copper deposits, electrowinning tests were conducted using the corresponding electrolyte compositions and a current density of 200 A/m² at 50° C. The quality of the deposits was determined visually after one day of electro-deposition. The test results are given in Table IV.

TABLE IV

| Additions to Electrolyte | | Overpotentials | | | |
|---|---|---|---|---|---|
| Glue mg/L | Thiourea mg/L | Nucleation mV | Plating mV | ΔV mV | Deposit Quality |
| 0.5 | 5 | −38 | −34 | −4 | rough |
| 10 | 5 | −30 | −15 | −15 | smooth |
| 5 | 10 | −30 | −24 | −6 | rough |
| 20 | 10 | −15 | +9 | −24 | rough |
| 20 | 0 | −42 | −14 | −28 | smooth |
| 5 | 5 | −41 | −33 | −7 | rough |
| 10 | 10 | −30 | −19 | −11 | rough |
| 20 | 5 | −40 | −15 | −25 | smooth |

Level, dense, i.e. smooth, deposits are obtained under the conditions of this example, when the plating overpotential is maintained at values in the range of −10 to −20 mV and the difference between the nucleation and plating overpotentials is maintained at values in the range of −13 to −30 mV. A diagram composed on the basis of FIG. 2 will indicate the area of optimum conditions. Similar to the figures for the other 3 examples, the diagram will show the areas wherein either one or the other agent is, or both agents are present in either too high or too low a concentration for obtaining level and dense deposits and adjustment in the concentration is indicated to return to optimum conditions.

The embodiments of the invention in which an exclusive property or privilege is claimed are defined as follows:

1. A method for controlling the electro-deposition of metal using an electrically conductive aqueous electrolyte containing concentrations of two organic polarizing agents including one agent which affects primarily grain refining, and one agent which affects the smoothness and levelness of the metal deposit, which method comprises:

(a) establishing a test cell circuit including at least one test cell; a sample of electrolyte; at least one anode; at least one cathode having a constant area in contact with the electrolyte; at least one reference electrode, a current supply means which is electrically connected to the anode(s) and the cathode(s); and an overpotential measuring means connected between the cathode and the reference electrode;

(b) applying a current in the test cell sufficient to cause electro-deposition of metal;

(c) measuring between a cathode and a reference electrode in a test cell the overpotential associated with the initial deposition or the nucleation of metal deposition onto a clean cathode surface, and termed the nucleation overpotential;

(d) measuring between a cathode and a reference electrode in a test cell the overpotential associated with metal deposition onto previously deposited metal, and termed the plating overpotential;

(e) relating the measured values of the nucleation overpotential, the plating overpotential, and the difference between values of the nucleation and plating overpotentials to previously determined optimum values; and (f) adjusting the process by changing the concentration of at least one of the organic polarizing agents in the electrolyte to obtain optimum metal deposition conditions when deviations from optimum values occur.

2. A method according to claim 1, wherein one cathode is used, said cathode is a moving cathode, the overpotentials are measured continuously at a substantially constant current, the cathode is moved at a rate below the transition rate $R_{trans}$ to measure the plating overpotential, and the cathode is moved at a rate above the transition rate $R_{trans}$ to measure the nucleation overpotential, the transition rate being that rate at which the exposed cathode surface becomes first substantially covered with deposited metal, said transition rate being defined by the formula $$R_{trans} = \frac{abcd}{xy} \text{ cm/h},$$

wherein:

a represents the cathode surface to area ratio, $cm/cm^2$ b represents the current density, $A/cm^2$ c represents the cathode exposed area, $cm^2$ d represents the electrochemical equivalent for the metal being deposited, g/Ah;

x represents the fraction of the exposed area covered with metal; and y represents the weight of deposited metal per unit of exposed cathode surface area, $g/cm^2$.

3. A method according to claim 1, wherein two cathodes are used said cathodes are moving cathodes, the overpotentials are measured continuously at a substantially constant current, one cathode is moved at a rate below the transition rate $R_{trans}$ to measure the plating overpotential, and the second cathode is moved at a rate above the transition rate $R_{trans}$ to measure the nucleation overpotential, the transition rate being that rate at which the exposed cathode surface becomes first substantially covered with deposited metal, said transition rate being defined by the formula $$R_{trans} = \frac{abcd}{xy} \text{ cm/h},$$

wherein:

a represents the cathode surface to area ratio, $cm/cm^2$;

b represents the current density, $A/cm^2$;

c represents the cathode exposed area, $cm^2$ d represents the electrochemical equivalent for the metal being deposited, g/Ah;

x represents the fraction of the exposed area covered with metal; and y represents the weight of deposited metal per unit of exposed cathode surface area, $g/cm^2$.

4. A method according to claim 2, or 3, wherein the rate to measure the plating overpotential is from one half to one tenth of $R_{trans}$.

5. A method according to claim 2, or 3, wherein the rate to measure the nucleation overpotential is such that x is in the range of about 0.5 to 0.9.

6. A method according to claim 2, or 3, wherein the rate to measure the nucleation overpotential is from two to ten times $R_{trans}$.

7. A method according to claim 1, 2, or 3, wherein the anode is made from a material chosen from the metal being deposited, lead silver alloys, platinum and graphite.

8. A method according to claim 1, 2, or 3, wherein the cathode is chosen from the metal being deposited and an electrically conductive material other than the metal being deposited and which is compatible with the electrolyte.

9. A method according to claim 1, wherein the cathode is a stationary cathode, the nucleation overpotential is measured under conditions of increasing current, the current being increased from zero to a maximum value at which substantially all of the exposed cathode area is covered with metal, and the plating overpotential is measured under conditions of decreasing current, the current being decreased to zero from said maximum value.

10. A method according to claim 9, wherein the rates of current increase and decrease are in the range of 5 to 1000 $A/m^2/min$.

11. A method according to claim 9, wherein the rates of current increase and decrease are in the range of 100 to 200 $A/m^2/min$.

12. A method according to claim 1, or 9, wherein:

(i) the test cell circuit includes one test cell having one anode, one cathode and one reference electrode; and (ii) both the nucleation overpotential and the plating overpotential are measured in sequence in the one cell.

13. A method according to claim 2, 3, or 9, wherein values of the plating overpotential, and the values of the differences between values of the plating and nucleation overpotentials are recorded and related to the concentration of the polarizing agents and the optimum values.

14. A method according to claim 1, wherein in step (f) the process is adjusted by adding to the electrolyte a depolarizing agent.

15. A method according to claim 1, wherein two cathodes are used, said cathodes are moving cathodes, said moving cathodes are moved at the same rate, the current applied at one cathode has a value such that the nucleation overpotential is measured, and the current applied at the other cathode has a value such that the plating overpotential is measured.

16. A method according to claim 1, 3 or 15, wherein:

(i) the test cell circuit includes two cells, each cell having an anode, a cathode and a reference electrode, the anodes and cathodes being connected in series to the current supply means;

(ii) the nucleation overpotential is measured in one of the two test cells; and (iii) the plating overpotential is measured in the other of the two test cells.

17. A method according to claim 1, 3, or 15, wherein:

(i) the test cell circuit includes one test cell having at least one anode, two cathodes, and two reference electrodes;

(ii) the nucleation overpotential is measured using anode, one cathode and one reference electrode together as a first set; and (iii) the plating overpotential is measured using anode, the second cathode, and the second reference electrode together as a second set.

* * * * *